US011804107B2

(12) United States Patent
Nelson et al.

(10) Patent No.: US 11,804,107 B2
(45) **Date of Patent: *Oct. 31, 2023**

(54) SYSTEM AND METHOD FOR PROVIDING SPORTING EVENT WAGERING OPPORTUNITIES REMOTE FROM A GAMING ESTABLISHMENT SPORTS BOOK

(71) Applicant: IGT, Las Vegas, NV (US)

(72) Inventors: Dwayne R. Nelson, Las Vegas, NV (US); Steven LeMay, Reno, NV (US); Kevin Higgins, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/707,431

(22) Filed: Mar. 29, 2022

(65) Prior Publication Data

US 2022/0223010 A1 Jul. 14, 2022

Related U.S. Application Data

(63) Continuation of application No. 16/654,576, filed on Oct. 16, 2019, now Pat. No. 11,295,578.

(51) Int. Cl.

| | |
|---|---|
| ***G07F 17/32*** | (2006.01) |
| ***G06Q 50/12*** | (2012.01) |
| ***G06Q 50/34*** | (2012.01) |

(52) U.S. Cl.

CPC ..... *G07F 17/3288* (2013.01); *G06Q 50/12* (2013.01); *G06Q 50/34* (2013.01); *G07F 17/3223* (2013.01)

(58) Field of Classification Search

CPC . G07F 17/3288; G07F 17/3223; G06Q 50/12; G06Q 50/34

See application file for complete search history.

(56) References Cited

U.S. PATENT DOCUMENTS

| | | | | |
|---|---|---|---|---|
| 3,952,298 | A | 4/1976 | Winkelmann | |
| 6,848,995 | B1 | 2/2005 | Walker et al. | |
| 7,103,903 | B1 | 9/2006 | Kydd | |
| 7,198,571 | B2 | 4/2007 | LeMay et al. | |
| 7,419,428 | B2 | 9/2008 | Rowe | |
| 8,282,488 | B2 | 10/2012 | Walker et al. | |
| 8,647,195 | B2 | 2/2014 | Brook et al. | |
| 8,858,323 | B2 | 10/2014 | Nguyen et al. | |
| 9,292,996 | B2 | 3/2016 | Davis et al. | |
| 9,430,909 | B2 | 8/2016 | Shore et al. | |
| 9,489,793 | B2 | 11/2016 | Williams et al. | |
| 10,055,930 | B2 | 8/2018 | Ramos et al. | |
| 2002/0151340 | A1 | 10/2002 | Guinn et al. | |
| 2003/0003988 | A1 * | 1/2003 | Walker | G07F 17/323 463/21 |

(Continued)

OTHER PUBLICATIONS

MCC Codes—Merchant Category Codes, https://web.archive.org/web/20180817153403/https://www.web-payment-software.com/online-merchant-accounts/mcc-codes/, Aug. 17, 2018 (Year: 2018).*

*Primary Examiner* — Kevin Y Kim

(74) *Attorney, Agent, or Firm* — Neal, Gerber & Eisenberg LLP

(57) ABSTRACT

Systems and methods which utilize a player account to place one or more wagers on one or more sporting event wagering opportunities remote from a gaming establishment sports book such as in association with a hotel room system.

20 Claims, 5 Drawing Sheets

(56) References Cited

U.S. PATENT DOCUMENTS

| | | | | |
|---|---|---|---|---|
| 2003/0083889 | A1* | 5/2003 | Macklin | G06Q 30/02 705/5 |
| 2003/0176218 | A1 | 9/2003 | LeMay | |
| 2005/0059493 | A1 | 3/2005 | Tyson et al. | |
| 2006/0019745 | A1* | 1/2006 | Benbrahim | G07F 17/3239 463/29 |
| 2006/0046853 | A1 | 3/2006 | Black | |
| 2006/0121970 | A1 | 6/2006 | Khal | |
| 2006/0258438 | A1 | 11/2006 | Platis | |
| 2007/0004518 | A1 | 1/2007 | Friesen et al. | |
| 2007/0060274 | A1 | 3/2007 | Rowe et al. | |
| 2007/0082740 | A1 | 4/2007 | Stearns et al. | |
| 2007/0087804 | A1 | 4/2007 | Knowles | |
| 2007/0155507 | A1 | 7/2007 | Gatto et al. | |
| 2008/0113807 | A1 | 5/2008 | Alderucci | |
| 2008/0161110 | A1 | 7/2008 | Campbell et al. | |
| 2009/0131134 | A1* | 5/2009 | Baerlocher | G07F 17/3293 463/40 |
| 2011/0034252 | A1 | 2/2011 | Morrison | |
| 2013/0053991 | A1 | 2/2013 | Ferraro, III et al. | |
| 2015/0089595 | A1 | 3/2015 | Telles et al. | |
| 2015/0245088 | A1 | 8/2015 | Bringue et al. | |
| 2015/0287278 | A1 | 10/2015 | Shore et al. | |
| 2015/0339888 | A1 | 11/2015 | Hong et al. | |
| 2016/0140804 | A1 | 5/2016 | Morgan | |
| 2018/0047254 | A1 | 2/2018 | Acton | |
| 2019/0156623 | A1 | 5/2019 | Thomas et al. | |

* cited by examiner

300

SYSTEM AND METHOD FOR PROVIDING SPORTING EVENT WAGERING OPPORTUNITIES REMOTE FROM A GAMING ESTABLISHMENT SPORTS BOOK

PRIORITY CLAIM

This application is a continuation of, claims priority to and the benefit of U.S. patent application Ser. No. 16/654,576, filed on Oct. 16, 2019, the entire contents of which is incorporated by reference herein.

TECHNICAL FIELD

The technical field of the present disclosure is that of systems and methods that utilize a player account to place one or more wagers on one or more sporting event wagering opportunities.

BACKGROUND

Sports betting terminals may enable a player to place a sports wager predicting the results of a sporting event.

BRIEF SUMMARY

In certain embodiments, the present disclosure relates to a system including a processor; and a memory device that stores a plurality of instructions. When executed by the processor, the instructions cause the processor to communicate data which results in a hotel room system displaying, via a display device of a hotel room, a sporting event. When executed by the processor responsive to a user authorization determination, the instructions cause the processor to receive data associated with a placement of a sporting event wager of a first amount of funds on an outcome of the displayed sporting event, and decrease an amount of funds associated with an account based on the first amount of funds of the placed sporting event wager. When executed by the processor after a determination that the placed sporting event wager comprises a winning sporting event wager, the instructions cause the processor to increase the amount of funds associated with the account based on a second amount of funds associated with the winning sporting event wager.

In certain embodiments, the present disclosure relates to a system including a processor; and a memory device that stores a plurality of instructions. When executed by the processor, the instructions cause the processor to receive, from a sporting event wagering system server, data associated with a sporting event and a sporting event wager available to be placed on the sporting event, and cause a hotel room display device to display, based on the received data, the sporting event and the sporting event wager available to be placed on the sporting event, wherein the sporting event is unavailable to be displayed via any channel accessible by the hotel room display device. When executed by the processor responsive to receipt of an input, via a hotel room input device, to place the sporting event wager, the instructions cause the processor to communicate data associated with the placed sporting event wager to the sporting event wagering system server, wherein an account associated with the hotel room is modified based on an amount of the placed sporting event wager.

In certain embodiments, the present disclosure relates to a method of operating a system including causing a display device of a hotel room to display a sporting event. Responsive to a user authorization determination, the method includes receiving data associated with a placement of a sporting event wager of a first amount of funds on an outcome of the displayed sporting event, and decreasing, by a processor, an amount of funds associated with an account based on the first amount of funds of the placed sporting event wager. After a determination that the placed sporting event wager comprises a winning sporting event wager, the method includes increasing, by the processor, the amount of funds associated with the account based on a second amount of funds associated with the winning sporting event wager.

Additional features are described herein, and will be apparent from the following Detailed Description and the figures.

DETAILED DESCRIPTION

Figure 1:
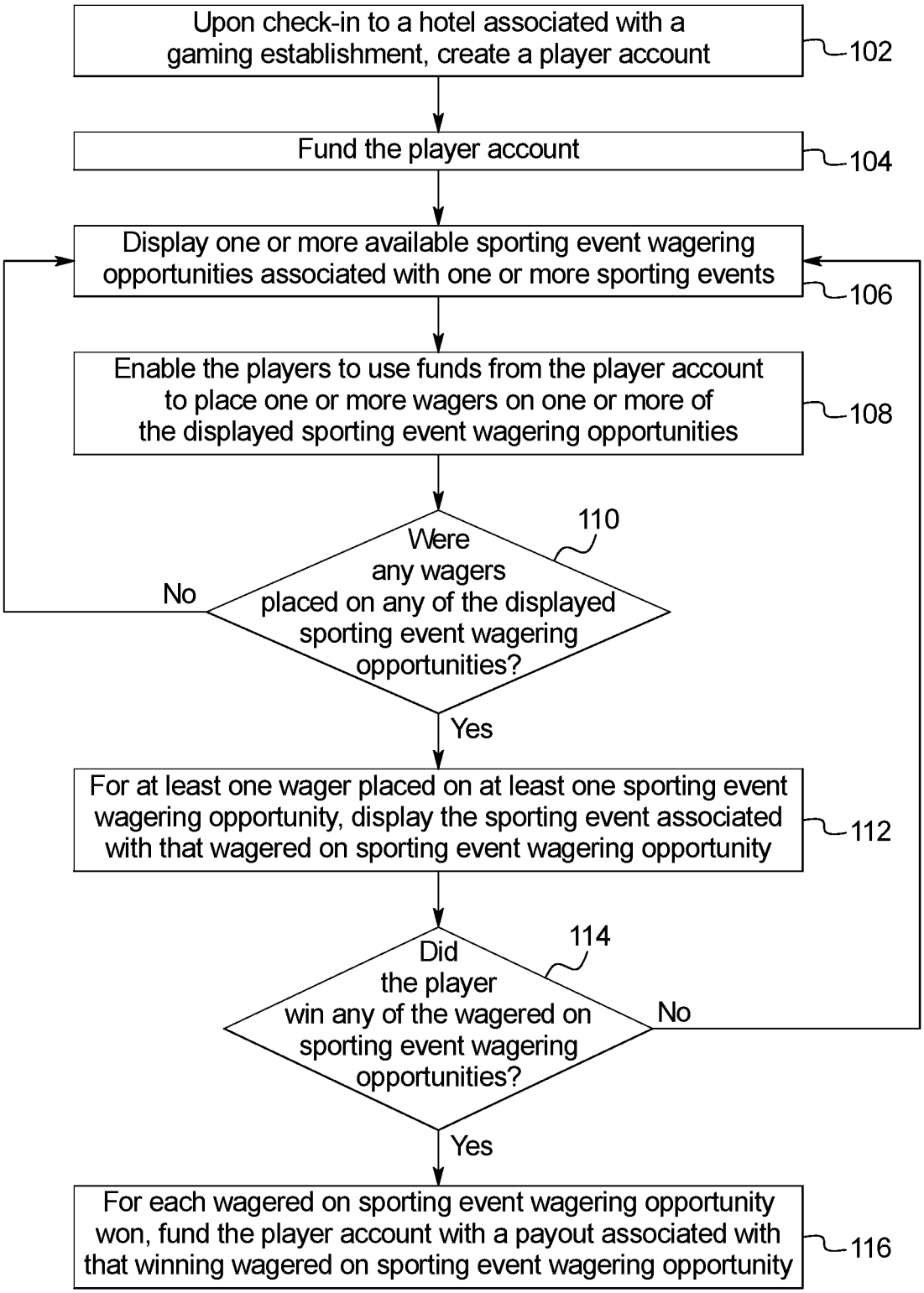
FIG. 1 is a flowchart of one embodiment of the system disclosed herein illustrating a creation and use of a player account to place one or more wagers on one or more sporting event wagering opportunities remote from a gaming establishment sports book.

Creating a Player Account for Placing Wagers on Sporting Event Wagering Opportunities The present disclosure relates generally to systems and methods which enable a user, such as a player, to utilize an account to place a sporting event wager on a sporting event displayed to a user remote from the gaming establishment sports book, such as in the user's hotel room via a hotel room system.

Specifically, in various embodiments, rather than requiring a user to travel to a gaming establishment sports book to place one or more sporting event wagers on one or more sporting events, the system disclosed herein enables the user to place such wagers from the comfort of their hotel room. In these embodiments, following a determination associated with authorizing a user access to the system, the system enables the user the opportunity to place one or more sporting event wagers on one or more sporting events via a hotel room system and utilizing an amount of funds maintained in (or otherwise accessible from) an account associated with the user. In such embodiments, the system operates with the hotel room system to modify the content available to be accessed via the hotel room system such that the user is not only provided a personalized experience in their hotel room via access to additional sporting event content, but the user also reaps the benefits of participating in sporting event wagering while enjoying such additional sporting event content from the privacy of their hotel room.

More specifically, in various embodiments, the system disclosed herein enables a user, such as a player, checking into a hotel associated with a gaming establishment to create a player account which the user may subsequently utilize to place a wager on one or more sporting event wagering opportunities while the user is within the confines of their hotel room. In such embodiments, since various jurisdictions include regulations that require gaming establishments to monitor wagering activity and enforce wagering limits on any wagers placed on sporting event wagering opportunities, the system disclosed herein utilizes the hotel check-in process to obtain certain player identification (e.g., a government issued driver's license and a credit card of the user) that enables gaming establishment to monitor the wagering activity and enforce any applicable wagering limits of any wagers placed on sporting event wagering opportunities.

In certain of these embodiments, in response to a user checking into a hotel associated with a gaming establishment, a system automatically creates (or enables the user to provide authorization for the creation of) an account that the user may utilize to place wagers on one or more sporting event wagering opportunities in the hotel room. In certain of these embodiments, in response to a user entering their hotel room, the hotel room system (which is in communication with the system disclosed herein) enables the user to utilize the account created during hotel check-in to place wagers on one or more sporting event wagering opportunities associated with sporting events displayed via the hotel room system, such as displayed by a television in the hotel room. In each of these embodiments, in response to a user accessing a display device in the hotel room, such as turning on a television in hotel room, the system disclosed herein displays a plurality of sporting event wagering opportunities associated with multiple sports channels for watching different sporting events in the hotel room. Such a configuration aids or otherwise provides an engaging experience for users by converting a passive experience (i.e., watching a sporting event in a hotel room) into an active activity (i.e., placing a wager on one or more sporting event wagering opportunities associated with a sporting event). Additionally, by integrating the creation of the account utilized to place wagers on one or more sporting event wagering opportunities with the hotel check-in process, the system enables the gaming establishment to track wagering amounts of the user to meet regulations.

Referring now to the drawings, FIG. 1 illustrates a flowchart of an example embodiment of a process for operating a system. In one embodiment, this process is represented by a set of instructions stored in one or more memory devices and executed by one or more processors or one or more servers. While this process is described with reference to the flowchart illustrated in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, or certain of the illustrated blocks and/or diamonds may not be employed.

In various embodiments, as indicated in block 102 of FIG. 1, upon check-in to a hotel associated with a gaming establishment, the system creates a player account (or otherwise accesses a previously created player account). As described in more detail below, the system disclosed herein utilizes a player account to fund one or more wagers placed on one or more sporting event wagering opportunities associated with one or more sporting events accessible to the player remote from a gaming establishment sports book, such as accessible to the player from a hotel room associated with the gaming establishment.

In one embodiment, the system creates the player account when a player checks into a hotel room associated with a gaming establishment. In this embodiment, the system creates the player account utilizing information provided by a guest (i.e., the player) during hotel check-in, such as, but not limited to, a government issued identification card, a government issued driver's license, a government issued passport, a government issued social security number, a portion of a government issued social security number (e.g., the last four digits), a gaming establishment player card, credit card information, debit card information, bank account information, biometric data (e.g., finger print, signature, or photo), or other such information. In one embodiment, the system accesses a previously created player account when a player checks into a hotel room associated with a gaming establishment. In these embodiments, the system links or otherwise associates the player account with a specific hotel room number that a player is staying in. As such, the system can track the wagering activity of the player account associated with the player's hotel room number.

In one embodiment, during creation of the player account during hotel check-in (and/or access to a previously created player account during hotel check-in), a hotel check-in system requires the player to acknowledge a set of rules associated with the player account by providing a signature or other such indication that the player has read and agrees to the set of rules associated with the player account. For example, the set of rules of the player account includes: wagering limits of the player account, authorized users of the player account, acceptable funding sources of the player account, and other such rules. In another embodiment, the set of rules associated with the player account are included in a set of rules associated with the player's stay in the hotel room. In this embodiment, when the player acknowledges and agrees to the set of rules associated with the hotel stay, the player also acknowledges and agrees to the set of rules associated with the player account.

In one embodiment, during check-in to the hotel, the player must positively authorize or opt-in to create the player account (or access a previously created player account) to enable wagering on sporting events in the player's hotel room. That is, if during hotel check-in the player indicates a desire to place wagers on sporting event wagering opportunities in the hotel room, then the system creates the player account (and/or accesses a previously created player account) to place wagers on one or more sporting event wagering opportunities while the player is in the hotel room. Conversely, if during hotel check-in the player does not indicates a desire to place wagers on sporting event wagering opportunities in the hotel room, then the system does not create the player account (or access a previously created player account) and the player is unable to place wagers on one or more sporting event wagering opportunities while the player is in the hotel room. It should be appreciated that if during hotel check-in the player does not enable the ability to place wagers on sporting event wagering opportunities in the hotel room, the player may authorize the creation of the player account at a later time during that hotel stay.

In one embodiment, the system automatically creates the player account (or accesses a previously created player account) based on player information provided by a player to a hotel check-in system while the player checks into the hotel. In this embodiment, the system utilizes information provided by the player such as, but not limited to, the age of the player, the home address of the player, previous preferences of the player, previous wagering history of the player, or other such information to automatically create the player account (or access a previously created player account) and enable the player to place wagers on one or more sporting event wagering opportunities in the player's hotel room. As such, the automatic creation of the player account reduces time spent by the player during hotel check-in because the player does not need to provide certain additional information (e.g., player age, or authorization to create player account) for the system to create the player account and enable the player to place a wager on one or more sporting event wagering opportunities in the player's hotel room.

In one embodiment, the system creates the player account based on information input by the player at a kiosk or other such registration device for the player account. In this embodiment, the player can utilize the kiosk during hotel check-in to authorize the creation of a player account/access to a previously created player account to enable wagering on sporting event wagering opportunities in the player's hotel room. Alternatively, the player can utilize the kiosk or mobile application prior to or after hotel check-in (and at any time during the player's stay in the hotel) to authorize the creation of a player account/access to a previously created player account to enable wagering on sporting event wagering opportunities in the player's hotel room.

In another embodiment, the system creates the player account/accesses a previously created player account based on information input by the player into a mobile application that the player downloads on a mobile device. In this embodiment, the player can utilize the mobile application prior to or during hotel check-in to authorize the creation of a player account/access to a previously created player account to enable wagering on sporting event wagering opportunities in the player's hotel room. Alternatively, the player can utilize the mobile application after hotel check-in (and at any time during the player's stay in the hotel) to authorize the creation of a player account/access to a previously created player account to enable wagering on sporting event wagering opportunities in the player's hotel room.

In one embodiment, during creation of the player account (and/or access to a previously created player account), the system utilizes the player information provided at hotel check-in to determine if there are any minors (i.e., guests under the legal gambling age) staying in the hotel room. In this embodiment, if the system determines there are no minors staying in the hotel room, then the system enables the player to freely utilize the player account for placing one or more wagers on sporting event wagering opportunities and/or non-sporting event wagering opportunities while in the hotel room as described herein. On the other hand, if the system determines that there are minors staying in the hotel room, then the system activates certain restrictions on the player account for placing wagers on one or more sporting event wagering opportunities. For example, if there are minors staying in the hotel room, the system generates a Personal Identification Number (PIN), or other such player identifier, associated with the player account. As such, to place a wager utilizing the player account, the system prompts the player to enter the PIN, or other such player identification, via an input device (e.g., a television remote control, a display device touch screen, or a player mobile device) to ensure that any minors staying in the hotel room do not utilize the player account to place wagers on sporting event wagering opportunities in the hotel room.

Returning to FIG. 1, once the system generates the player account, the system enables the player to fund the player account as indicated in block 104 of FIG. 1. In one embodiment wherein the system automatically creates or accesses the player account during check-in to a hotel associated with a gaming establishment, the player account includes or is otherwise associated with a wagering account fundable by the player (and utilized by the player to place wagers on sporting event wagering opportunities while the player is a guest at the hotel). In this embodiment, the system enables the player to fund the player account using credit card information, debit card information, bank account information, hotel room account information, currency, or other such funding source provided by the player during hotel check-in. In another embodiment, the system requires the player to visit a sports book of the gaming establishment to fund the player account using credit card information, bank account information, hotel room account information, currency, or other such funding source provided by the player. In various embodiments, if the player needs to add additional funds to the player account during the player's stay in the hotel, the system enables the player to transfer additional funds from a previously provided funding source (e.g., credit card, bank account, or hotel room account) and apply those additional funds to the player account for the player to utilize.

In one embodiment, the player utilizes funds in the player account for placing wagers on sporting event wagering opportunities in the hotel room. Additionally, in this embodiment the player can utilize the funds in the player account for other hotel and/or gaming establishment activities such as, but not limited to, playing slot machines, playing table games, purchasing food and beverages, purchasing entertainment tickets (e.g., tickets for a show), purchasing spa treatments, and other such hotel and/or gaming establishment activities.

In one embodiment, when funding the player account, the system enables a set of regulations on the funds added to the player account for placing wagers on sporting event wagering opportunities. In this embodiment, the regulations on the player account are configured such that the system monitors the wagering activity of the player while utilizing the player account. For example, certain regulations associated with wagering on sporting event wagering opportunities include placing a maximum wagering amount that a player can wager in a 24-hour period, a wagering session, or other such wagering timeframe. In this embodiment, the system uses player information collected during creation of the player account such as, a government issued identification card, a government issued driver's license, a government issued passport, a government issued social security number, a portion of a government issued social security number (e.g., the last four digits), a gaming establishment player card, credit card information, debit card information, bank account information, biometric data (e.g., finger print, signature, retinal scan or facial feature scan or photograph), or other such information to set up monitoring of the player account. In certain such embodiments, the player provides such information to verify their identity. In certain other such embodiments, the system collects such information from the player to create and monitor an anonymous identification associated with a player (wherein such collected information is utilized to verify the anonymous player). As such, the system monitors any wagers placed by a player using the player account against the maximum wager amount that the player can wager during the 24-hour period. In one embodiment, if the player exceeds this maximum wager amount, the system may notify the player that wagering limits have been reached and the system disables the player from placing additional wagers utilizing the player account for the remainder of the 24-hour period.

In one embodiment, the player account is associated with a hotel account associated with the player's hotel room (e.g., the player's hotel bill). As such, the player account is funded utilizing the hotel account (or a funding source attached to the hotel account) associated with the player's hotel room. In this embodiment, any wagers placed on sporting event wagering opportunities utilizing the player account are funded by the hotel account. That is, when a player places a wager utilizing the player account, the system charges the hotel account associated with the player's hotel room for the placed wager. As such, upon check-out from the hotel the player pays any remaining outstanding balance of the player account for any wagers placed on sporting event wagering opportunities in the player's hotel room, and the player receives any remaining payouts received by the player account from wagers placed on sporting event wagering opportunities in the player's hotel room. For example, an adult player checks into the hotel and the system enables a player account funded by the player's hotel account for wagering on one or more sporting event wagering opportunities in the player's hotel room. Upon entering the room and turning on the television, the system displays one or more available sporting event wagering opportunities for one or more sporting events, such as a football game, for the player to place a wager on. The player places a wager (e.g., a $40.00 wager) that Team X will win the football game (i.e., one of the available sporting event wagering opportunities). If the player loses that wager on the football game, the lost wager amount (i.e., $40.00) is added to the player's hotel account. Thus, upon check-out from the hotel, the player owes the hotel the lost wager amount in addition to the room rental fees, and any other hotel and resort fees associated with the player's stay. In another embodiment, each wager placed and resolved wager won (prior to the player checking out of the hotel room) appears as a separate line item on the player's hotel bill such that the player can see the full debits and credits associated with the wager and potential winnings.

It should be appreciated that in certain embodiments wherein the player account is included in the hotel account associated with the player's hotel room, the system places a limit on the amount that the player can wager on sporting events (e.g., $200 wager limit on sporting events per day) such that any wagers placed on sporting events and added to the player's hotel account do not account for a majority of the charges on the hotel account. In one such embodiment, the hotel account may be used for various spending within a gaming establishment, including wagering on sporting event wagering opportunities and wagers on games of chance or games of skill, wherein the amount (up to the wager limit) used on wagering opportunities are in the form of a balance of non-cashable credits which are not redeemable for cash. In this embodiment, when the player checks out of the hotel, the system settles the outstanding balance of non-cashable credits used for wagering against any wins credited to the hotel account to determine an amount of the hotel bill attributed to wagering.

It should be appreciated that this embodiment of utilizing a hotel account for wagering opportunities within the gaming establishment provides the benefit of the hotel and/or gaming establishment being able to use a merchant category code (MCC) consistent with charging for lodging activity (i.e., hotel fees associated with the stay) rather than using an MCC consistent with casino gambling because the majority of credit card issuing banks generally approve charges associated with lodging activity but may deny charges associated with casino gambling. That is, if all wagers placed on sporting events which are added to the player's hotel account are less than charges on the hotel account associated with the hotel stay (including, but not limited to, additional accrued charges, such as monies spent at restaurants associated with the hotel and/or a hotel spa), then the hotel account charges the wagers placed on sporting events using an MCC associated with the hotel stay. On the other hand, if all wagers placed on sporting events which are added to the player's hotel account are greater than charges on the hotel account associated with the hotel stay, then the hotel account charges the wagers placed on sporting events using an MCC associated with casino gambling. In this embodiment, the wagering limit may be consistent with (or in addition to) the regulations discussed above that place a maximum amount a player may wager in a 24-hour period.

In certain embodiments, upon the placement of sporting event wagers and/or the placement of non-sporting event wagers, the system creates a betting slip (in paper or electronic form) associated with placed wager. In one such embodiment, the betting slips are provided to the player upon creation, such as being emailed to the player (if in electronic form) or printed by a printer (located in the hotel room). In another such embodiment, the betting slips are provided to the player along with a hotel bell upon checking out of the hotel, such as being emailed to the player (if in electronic form) or printed by a printer.

In one embodiment, upon creation of the player account or access to a previously created player account, the hotel and/or gaming establishment provides the player with promotional wagers, credits, and/or other such awards to fund the player account. For example, when a player checks into the hotel and upon generation of the player account, the system automatically provides the player a promotional credit (e.g., $50.00) to use for wagering on one or more sporting event wagering opportunities in the player's hotel room. As such, the promotional credit introduces the player to using the player account for placing wagers on sporting event wagering opportunities in the player's hotel room. In this embodiment, the funding of the player account with promotional wagers, credits, and/or other such awards provides a benefit to the player and the gaming establishment because the player can experience utilizing the player account to place wagers on one or more sporting event wagering opportunities in the player's hotel room. Additionally, if the player enjoys placing wagers on sporting event wagering opportunities while in the hotel room, then the player may place additional wagers on sporting event wagering opportunities. In one embodiment, these promotional wagers, credits, and/or other such awards are part of a player loyalty rewards program, a new player rewards program, a frequent player rewards program, a bonus award, or other such award. As such, in one embodiment, the hotel and/or gaming establishment may provide the promotional wagers, credits, and/or other such awards to a specific group of players, while another group of players may not receive the promotional wagers, credits, and/or other such awards.

Figure 2A:
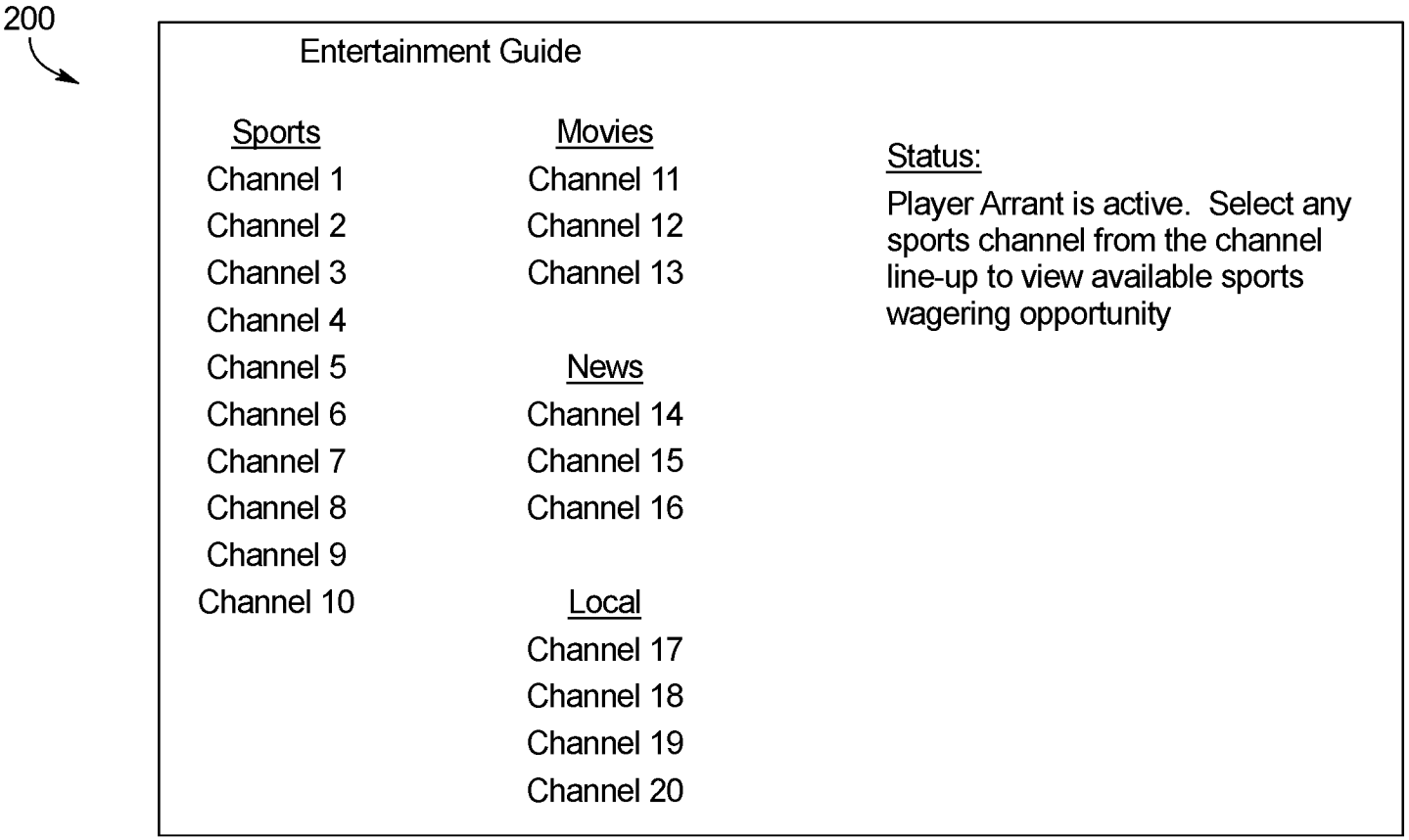
FIGS. 2A, 2B, and 2C are front views of one embodiment of the system disclosed herein illustrating the utilization of a display device in a hotel room to display a sporting event associated with one or more wagered on sporting event wagering opportunities.
Figure 2B:
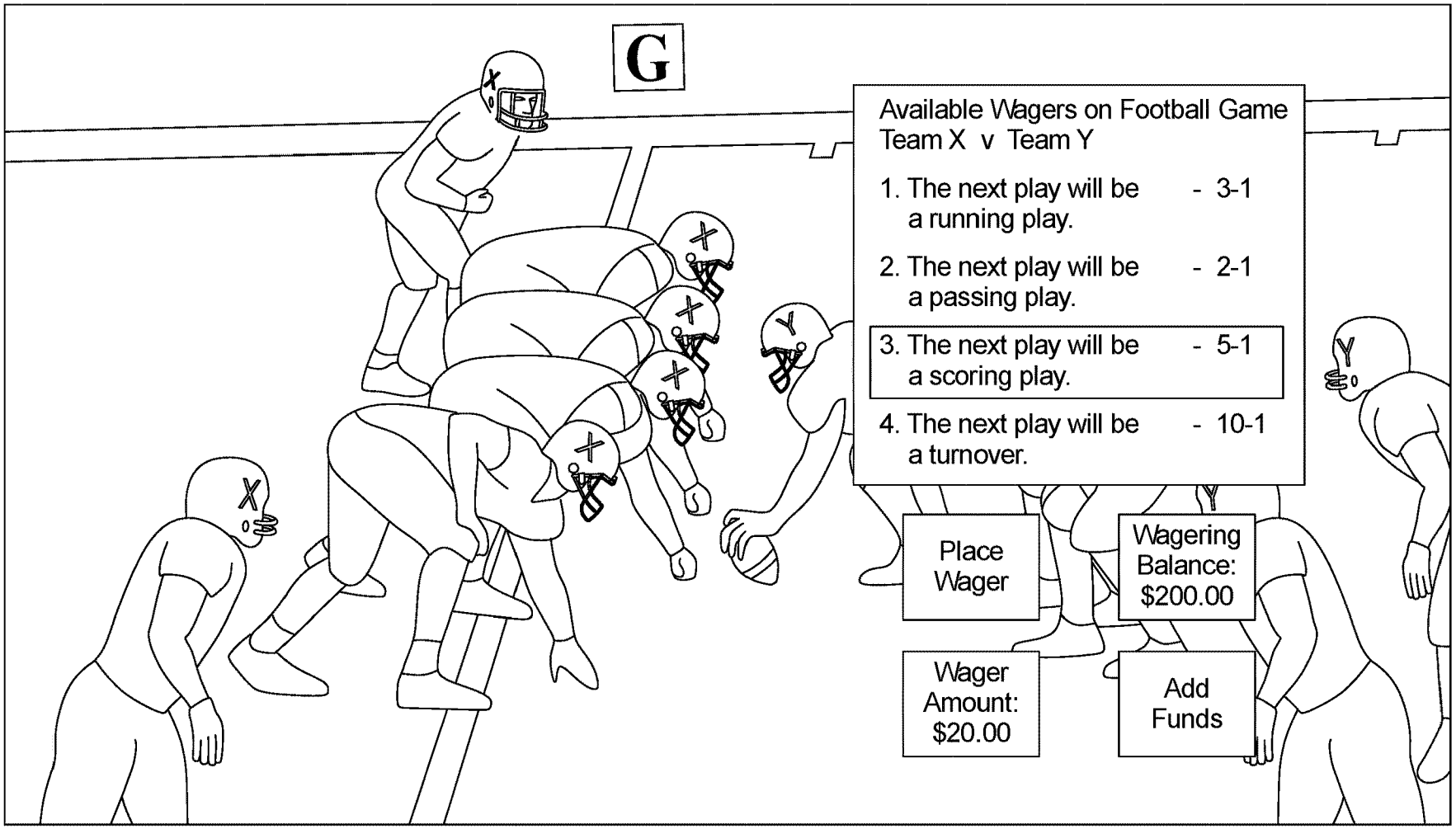
Figure 2C:
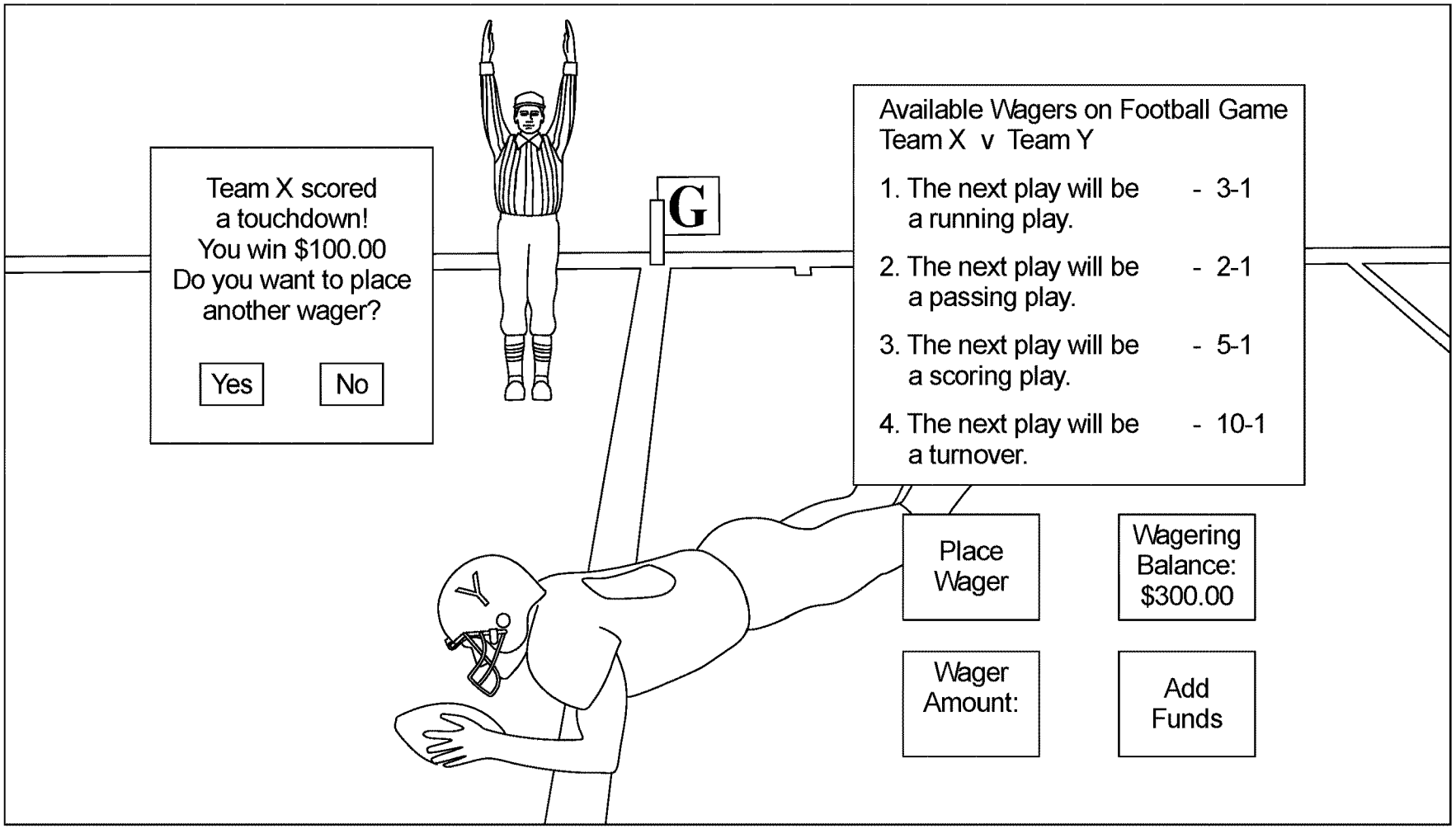

Once the player account is funded, following a determination to authorize the player to access the system, such as upon the player logging into the system and upon the player accessing a television or other media content display device in the hotel room, the system displays one or more available sporting event wagering opportunities as indicated in block 106 of FIG. 1. In one embodiment, the system uses a television, a SmartTV (i.e., a television which executes an application to enable wagering on sporting event wagering opportunities as described herein via the application), a computer, a mobile device, or other such media delivery device to display the one or more sporting event wagering opportunities to the player while the player is in the hotel room. For example, as shown in FIGS. 2A to 2C, when the player enters the hotel room and turns on the television, the system first displays an entertainment guide 200 that lists a plurality of available channels for the player such as sports channels, movie channels, news channels, and local channels. In this embodiment, the entertainment guide 200 further displays a message to the player, "Player Account is active, select a sports channel from the sports channel line-up for available sports wagering opportunities." As such, in this illustrated example, when a player (having an enabled player account) enters their hotel room and turns on a television, the system notifies the player that the player account is active and that the player can view one or more sporting event wagering opportunities on the television and/or one or more non-sporting event wagering opportunities on the television.

In one embodiment, for the hotel room of a player having a player account, the system enables the player to access the sporting event wagering opportunities on the television and/or the non-sporting event wagering opportunities on the television via an application of the television. In another embodiment, for the hotel room of a player having a player account, the system enables a different set of channels displayed on the television, or other such media content display device, in that hotel room. For example, the hotel may typically offer a variety of sports channels, news channels, movie channels, history channels and other such television channels for guests to enjoy while in the hotel room. In one embodiment, when a player checks into the hotel and enables the player account to place wagers on one or more sporting event wagering opportunities, the system adds additional sports channels to the television content available to the player. As a result, the additional sports channels provide an increase in sporting event content and an increase in available sporting event wagering opportunities associated with the available television content in the player's hotel room. In one example embodiment, as best seen in FIG. 2A, an entertainment guide 200 displayed on a player's television includes more sports channels than movie channels, news channels, and local channels. As such, in this embodiment, when the player enables the player account for placing wagers on one or more sporting event wagering opportunities, the system increases the available sporting event wagering opportunities available to the player by adding additional sports channels to the player's hotel room channel line-up.

In one embodiment, the system changes a display of a channel guide such that the sports channels are listed early in the channel guide and other channels (i.e., news channels, movie channels and history channels) are listed later in the channel guide. More specifically, in this embodiment, the system displays a group of sports channels (e.g., sports channels 1 to 10) before groups of other channels (e.g., movie channels, news channels, and local channels) on the entertainment guide 200. Thus, the system configures the display of available channels such that the sports channels are relatively easily accessible to the player. In another embodiment, the system designates (or the player designates) a sports channel as the default channel displayed when the television is first turned on. In this embodiment, the system chooses the default sports channel based on player preferences, player viewing history, player wagering history or other such preference and/or history. As such, when the player first turns on the television, the system directs the player to a specific sports channel that includes sporting event wagering opportunities that the player may be interested in placing a wager on.

In one embodiment, the system overlays or otherwise displays the available sporting event wagering opportunities on the television. For example, as best seen in FIG. 2B, if a player with a player account selects to watch a football game between Team X and Team Y, the system displays a plurality of football game wagering opportunities such as plurality of different pre-game wagers, in-game wagers and any other such wagers available to place on the football game. In this embodiment, the system communicates with a hotel video system that sends video data to the hotel rooms such that any available sporting event wagering opportunities are included in video signals transmitted by the hotel video system. In this illustrated example, the system overlays the available sporting event wagering opportunities on top of the displayed sporting event. As a result, the player can view the available sporting event wagering opportunities while simultaneously viewing the sporting event displayed on the television in the player's hotel room.

In another embodiment, the system scales down the display of the sporting event and the available sporting event wagering opportunities are displayed in an area besides the displayed sporting event, below the displayed sporting event, or above the displayed sporting event. In this embodiment, the system displays an unobstructed view of the sporting event while also displaying the available sporting event wagering opportunities associated with the sporting event. As a result, the player can view the available sporting event wagering opportunities while simultaneously viewing the sporting event displayed on the television in the player's hotel room.

It should be appreciated that while the available sporting event wagering opportunities are discussed with respect to a football game, the system disclosed herein enables the placement of any suitable type of wager on any event, such as any suitable sporting event or any suitable non-sporting event, accessible from a device associated with a gaming establishment patron that qualifies to place such a wager. In these embodiments, the sporting events available to be wagered on include any suitable event of any suitable sport at any professional and/or amateur level including, but not limited to, football, basketball, baseball, boxing, horse racing, wrestling, mixed martial arts, golf, cricket, soccer, hockey, field hockey, tennis, volleyball, table tennis, rugby, swimming, diving, archery, cycling, billiards, fishing, gymnastics, hunting, track and field, sailing, and/or car racing. In these embodiment, the non-sporting event available to be wagered on include any suitable non-sport with an initially outcome unknown which a gaming establishment presents odds for, such as wagering on political events or wagering on televised wagering events (e.g., wagering on televised poker tournament events). It should be further appreciated that one or more of the available sporting event wagering opportunities and the associated sporting events that the system displays may be selected by a player, selected by an operator, such as a gaming establishment operator, or selected based on scheduling (i.e., which sporting events are currently being played live), popularity (e.g., sporting events including sports teams from more populous cities are selected over sporting events including sports teams from less populous cities) and/or location (e.g., a sporting event played at a first location relatively closer to a gaming establishment is selected over a sporting event played at a second location relatively further away from the gaming establishment.

In certain embodiments, one or more of the available sporting event wagering opportunities displayed include sporting event wagering opportunities associated with a live or upcoming sporting event wherein the system displays information (e.g., live sports book information obtained via a sports betting service) regarding the live or upcoming sporting event. In certain embodiments, one or more of the available sporting event wagering opportunities displayed include sporting event wagering opportunities associated with historical sporting events, such as a prerecorded sporting event, or a recreation of a prior sporting event. In these embodiments, to prevent players from determining an outcome of the historic sporting event prior to placing any wagers on one or more sporting event wagering opportunities associated with that historic sporting event, the system masks certain of the identifying information associated with that sporting event. That is, the system anonymizes identifying information about teams, historical team records, sporting event players, and/or historical sporting event player statistics each time that information is presented to players to select whether to wager on a given sporting event wagering opportunity.

In certain embodiments, one or more of the available sporting event wagering opportunities are associated with virtual or electronic sport ("eSport") events. In these embodiments, such virtual or eSports events are played by humans, by computer driven participants or by a mix of human and computer driven participants.

In certain embodiments, the system displays to the player pertinent wagering information regarding the one or more sporting event wagering opportunities available to be placed, such as, but not limited to, the participants in the sporting event (including historic information regarding such participants in the sporting event), the odds of a particular action or event occurring in the sporting event, the amounts available to be wagered, and/or the awards provided if the different sporting event wagering opportunities are determined to be winning wagers placed on sporting event wagering opportunities. It should be appreciated that the sporting event wagering opportunities displayed to the player includes any suitable sporting event wagering opportunity including, but not limited to, any suitable moneyline wager on an outcome of a sporting event (e.g., Team X will win the game), any suitable wager on an outcome of a sporting event which accounts for a point spread (e.g., Team X will win the game by ten points), any suitable proposition wager on an in-game event occurring or not occurring within the sporting event (e.g., Player A will score the next touchdown), any suitable handicap wager, any suitable if and reverse wager, any suitable total/over-under wager, any suitable full cover wager, any suitable future/outright wager, any suitable parlay/accumulator multiple sporting event wagers (including but not limited to a progressive parlay wager, a teaser and pleaser wager, a grand salami wager, and/or a round robin wager) and/or any combination of these different available sporting event wagering opportunities.

In certain embodiments, the available sporting event wagering opportunities are associated with a wager amount and a parimutuel award which is determined after all sporting event wagers have been placed on the available sporting event wagering opportunities. In these embodiments, the selection of a sporting event wagering opportunity includes the selection of an amount to wager on the sporting event wagering opportunity wherein all sporting event wagering opportunities of a particular type are placed together in a pool and then after the deduction of applicable fees (e.g., the vigorish) and/or taxes, the payoff odds are determined by sharing the pool among all winning bets. For example, a system displays a sporting event wagering opportunity to a player that they can place a wager of $50 that the next play of the stream of the professional football game will be a running play wherein the win amount (if the placed wager on the sporting event wagering opportunity is a winning wager) is determined after everyone in the system has wagered on what the next play of the stream of the professional football game will be.

In certain embodiments, the system enables the player to reject one or more of the sporting event wagering opportunities available to be placed and select another one or more different sporting event wagering opportunities to potentially wager on. That is, similar to a sports book wherein a player is presented with many sporting event wagering opportunities that they can place different wagers upon, the system enables a player to reject one or more of the sporting event wagering opportunities presented to the player such that another subset of one or more sporting event wagering opportunities are subsequently presented to be potentially placed. In another embodiment, multiple sporting event wagering opportunities within the sporting event are presented to the player, and the system enables the player pick a subset of the sporting event wagering opportunities presented to place. In this embodiment, if the player picks more than one sporting event wagering opportunity to place within one or more sporting events, the system employs a parlay bet with adjusted odds. In another embodiment, the system requires the player to place a primary wager on a sporting event wagering opportunity wherein two or more subsequent sporting event wagering opportunities placed within one or more sporting events are associated with a parlay bet with adjusted odds.

In one embodiment, once the system displays the available sporting event wagering opportunities, the system enables the player to use funds from the player account to place one or more wagers on one or more of the displayed sporting event wagering opportunities, as indicated in block 108 of FIG. 1. In this embodiment, the player uses an input device such as a television remote control, a touch screen on the television display, a touch screen on the television remote control, a mobile device associated with a user, such as a smart phone, a mobile device connected to the system such as a tablet associated with a hotel room or provided by a gaming establishment, or other such input device to input a selection of one or more sporting event wagering opportunities and input a wager amount associated with the selected one or more sporting event wagering opportunities. For example, as seen in FIG. 2B, the player selects a sporting event wagering opportunity (i.e., that the next play of the football game will be a scoring play) and the player inputs a wager amount of $20.00 for this selected sporting event wagering opportunity into a wager amount meter. The player then selects the place wager button to place this wager and the system deducts the wager amount from the wagering balance of the player account and operates with one or more sporting event wagering system servers to cause the selected sporting event wager to be placed.

In one embodiment, the system enables the player to freely input and confirm one or more wagers placed on the displayed sporting event wagering opportunities. In another embodiment, the system requires the player to first input a PIN, a password, or other such player identifier prior to enable the player to input and confirm one or more wagers placed on the displayed sporting event wagering opportunities.

In addition to enabling the player to use funds from the player account to place wagers on the displayed sporting event wagering opportunities, the system monitors if any wagers were placed on any of the displayed sporting event wagering opportunities, as indicated in diamond 110 of FIG. 1. In one embodiment, if the system determines that at least one wager was placed on at least one sporting event wagering opportunity, then the system displays the sporting event associated with that wagered on sporting event wagering opportunity, as indicated in block 112 of FIG. 1. In various embodiments, the system enables the player to place wagers on additional sporting event wagering opportunities. As such, a player may have a wager placed on one or more sporting event wagering opportunities at any given time. On the other hand, at diamond 110 of FIG. 1, if the system determines that there were not any wagers placed on any of the displayed sporting event wagering opportunities, then the system continues to display one or more available sporting event wagering opportunities associated with one or more sporting events, as indicated in block 106 of FIG. 1.

In one embodiment, once the system determines that at least one wager was placed on at least one sporting event wagering opportunity and displays the sporting event associated with that wagered on sporting event wagering opportunity, then the system determines if the player won any of the wagers placed on one or more sporting event wagering opportunities, as indicated in diamond 114 of FIG. 1. In one embodiment, if the system determines that the player won at least one wager that was placed on at least one sporting event wagering opportunity, then the system funds the player account with a payout associated with that winning wagered on sporting event wagering opportunity, as indicated in block 116 of FIG. 1. On the other hand, at diamond 114 of FIG. 1, if the system determines that the player did not win any of the wagered on sporting event wagering opportunities, then no funding of the player account occurs and the system continues to display one or more available sporting event wagering opportunities associated with one or more sporting events, as indicated in block 106 of FIG. 1.

In one illustrated example, as best seen in FIG. 2C, if the system determines that the player won a wager that was placed on at least one sporting event wagering opportunity, the system displays a notification on the television or other display device indicating that the player won a wager placed on at least one sporting event wagering opportunity. In this illustrated example, the player placed a wager on the football game that the next play would be a scoring play, and during the next play of the football game, Team X scored a touchdown. As such, the system displays a notification "Team X scored a touchdown! You win $100.00." In this example, the system then funds or otherwise adds the payout associated with the winning wager to the player account (e.g., wagering balance). In this embodiment, the notification further includes "Do you want to place another wager?" The system enables the player to select either "Yes" or "No" to place a wager on at least one or more additional sporting event wagering opportunities. In this illustrated example, if the player selects "Yes," then the system displays available sporting event wagering opportunities for the football game. On the other hand, if the player selects "No," then the system will continue to display the football game and await further input from the player.

Alternative Embodiments

It should be appreciated that in different embodiments, one or more of:

i. whether to enable a player to place one or more sporting event wagers remote from a gaming establishment sports book;

ii. whether to place any restrictions on a player account created/accessed to enable a player to place sporting event wagers remote from a gaming establishment sports book;

iii. which sporting events to display via a hotel room system;

iv. which sporting event wagers to enable a player to place remote from a gaming establishment sports book;

v. whether to modify a hotel room system to enable a player to place sporting event wagers remote from a gaming establishment sports book;

vi. how to modify a hotel room system to enable a player to place sporting event wagers remote from a gaming establishment sports book; and/or vii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination, determined independent of a random determination, determined based on a player's selection, determined independent of a player's selection, determined based on one or more wagers placed, determined independent of one or more wagers placed, determined based on time (such as the time of day), determined independent of time (such as the time of day), determined based on an amount of coin-in accumulated in one or more wagers, determined independent of an amount of coin-in accumulated in one or more wagers, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

System Components

The above-described embodiments of the present disclosure may be implemented in accordance with or in conjunction with one or more of a variety of different types of system components which operate with zero, one or more servers to enable a player to place sporting event wagers remote from a gaming establishment sports book, such as via a hotel room system.

Figure 3:
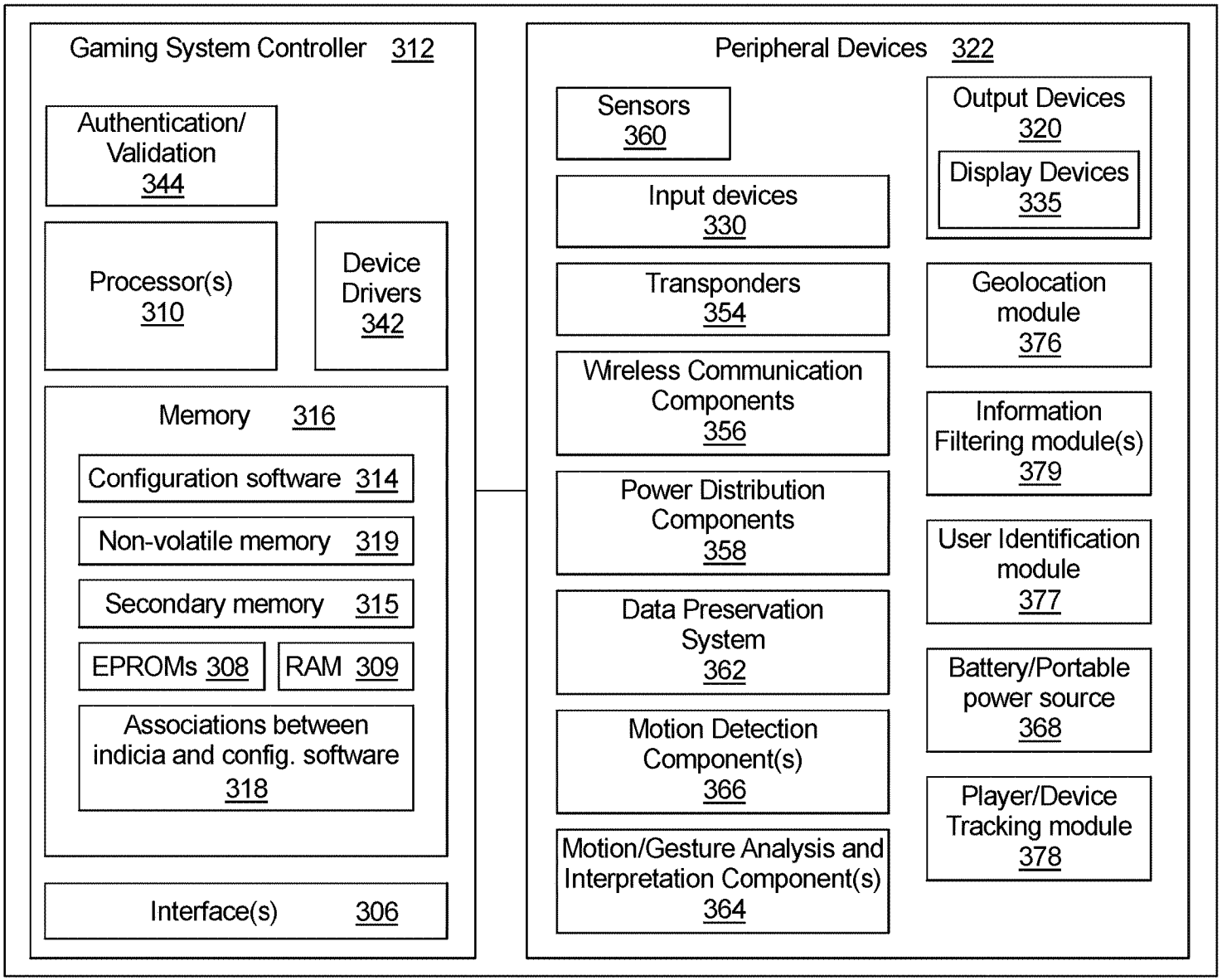
FIG. 3 is a schematic block diagram of one embodiment of an electronic configuration of an example system disclosed herein.

In certain embodiments, as seen in FIG. 3, the system 300 includes a system controller 312 configured to communicate with and to operate with a plurality of peripheral devices 322.

The system controller 312 includes at least one processor 310. The at least one processor 310 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information) via a communication interface 306 of the system controller 312; (2) converting signals read by an interface to a format corresponding to that used by software or memory of the system; (3) accessing memory to configure or reconfigure parameters in the memory according to indicia read from the system; (4) communicating with interfaces and the peripheral devices 322 (such as input/output devices); and/or (5) controlling the peripheral devices 322. In certain embodiments, one or more components of the system controller 312 (such as the at least one processor 310) reside within a housing of the system (described below), while in other embodiments at least one component of the system controller 312 resides outside of the housing of the system.

The system controller 312 also includes at least one memory device 316, which includes: (1) volatile memory (e.g., RAM 309, which can include non-volatile RAM, magnetic RAM, ferroelectric RAM, and any other suitable forms); (2) non-volatile memory 319 (e.g., disk memory, FLASH memory, EPROMs, EEPROMs, memristor-based non-volatile solid-state memory, etc.); (3) unalterable memory (e.g., EPROMs 308); (4) read-only memory; and/or (5) a secondary memory storage device 315, such as a non-volatile memory device, configured to store gaming software related information (the software related information and the memory may be used to store various audio files not currently being used and invoked in a configuration or reconfiguration). Any other suitable magnetic, optical, and/or semiconductor memory may operate in conjunction with the system disclosed herein. In certain embodiments, the at least one memory device 316 resides within the housing of the system (described below), while in other embodiments at least one component of the at least one memory device 316 resides outside of the housing of the system.

The at least one memory device 316 is configured to store, for example: (1) configuration software 314, such as all the parameters and settings on the system; (2) associations 318 between configuration indicia read from a system with one or more parameters and settings; (3) communication protocols configured to enable the at least one processor 310 to communicate with the peripheral devices 322; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the system to communicate with local and non-local devices using such protocols. In one implementation, the system controller 312 communicates with other devices using a serial communication protocol. A few non-limiting examples of serial communication protocols that other devices, such as peripherals (e.g., a bill validator or a ticket printer), may use to communicate with the system controller 312 include USB, RS-242, and Netplex (a proprietary protocol developed by IGT).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PUP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 316 is configured to store program code and instructions executable by the at least one processor of the system to control the system. The at least one memory device 316 of the system also stores other operating data, such as image data, event data, input data, or information, and/or applicable rules on the system. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in a system to implement at least part of the present disclosure. In other embodiments, part or all of the program code and/or the operating data is downloaded to the at least one memory device of the system through any suitable data network described above (such as an Internet or intranet).

The at least one memory device 316 also stores a plurality of device drivers 342. Examples of different types of device drivers include device drivers for system components and device drivers for the peripheral components 322. Typically, the device drivers 342 utilize various communication protocols that enable communication with a particular physical device. The device driver abstracts the hardware implementation of that device. For example, a device driver may be written for each type of card reader that could potentially be connected to the system. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the system loads the new device driver from the at least one memory device to enable communication with the new device. For instance, one type of card reader in the system can be replaced with a second different type of card reader when device drivers for both card readers are stored in the at least one memory device.

In certain embodiments, the software units stored in the at least one memory device 316 can be upgraded as needed. For instance, when the at least one memory device 316 is a hard drive, new parameters, new settings for existing parameters, new settings for new parameters, new device drivers, and new communication protocols can be uploaded to the at least one memory device 316 from the system controller 312 or from some other external device. As another example, when the at least one memory device 316 includes a CD/DVD drive including a CD/DVD configured to store options, parameters, and settings, the software stored in the at least one memory device 316 can be upgraded by replacing a first CD/DVD with a second CD/DVD. In yet another example, when the at least one memory device 316 uses flash memory 319 or EPROM 308 units configured to store options, parameters, and settings, the software stored in the flash and/or EPROM memory units can be upgraded by replacing one or more memory units with new memory units that include the upgraded software. In another embodiment, one or more of the memory devices, such as the hard drive, may be employed in a software download process from a remote software server.

In some embodiments, the at least one memory device 316 also stores authentication and/or validation components 344 configured to authenticate/validate specified system components and/or information, such as hardware components, software components, firmware components, peripheral device components, user input device components, information received from one or more user input devices, information stored in the at least one memory device 316, etc.

In certain embodiments, the peripheral devices 322 include several device interfaces, such as: (1) at least one output device 320 including at least one display device 335, such as a hotel room television; (2) at least one input device 330 such as a hotel room remote control (which may include contact and/or non-contact interfaces); (3) at least one transponder 354; (4) at least one wireless communication component 356; (5) at least one wired/wireless power distribution component 358; (6) at least one sensor 360; (7) at least one data preservation component 362; (8) at least one motion/gesture analysis and interpretation component 364; (9) at least one motion detection component 366; (10) at least one portable power source 368; (11) at least one geolocation module 376; (12) at least one user identification module 377; (13) at least one player/device tracking module 378; and (14) at least one information filtering module 379.

The at least one output device 320 includes at least one display device 335 configured to display any information displayed by the system and any other suitable information. In certain embodiments, the display devices are connected to or mounted on a housing of the system (described below).

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

In certain embodiments, the at least one output device 320 is a sound generating device controlled by one or more sound cards. In one such embodiment, the sound generating device includes one or more speakers or other sound generating hardware and/or software configured to generate sounds.

The at least one input device 330 may include any suitable device that enables an input signal to be produced and received by the at least one processor 310 of the system.

In various embodiments, the at least one input device 330 includes a plurality of buttons that are programmable by the system operator to, when actuated, cause the system to perform particular functions. In certain embodiments, the at least one input device 330 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the system by touching the touch screen at the appropriate locations.

In embodiments including a player tracking system, the at least one input device 330 includes a card reader in communication with the at least one processor of the system which enables a player to log into the system and access sporting event content via a hotel room system.

The at least one wireless communication component 356 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 356 transmits electrical, electromagnetic, or optical signals that carry digital data streams or analog signals representing various types of information.

The at least one wired/wireless power distribution component 358 includes components or devices that are configured to provide power to other devices. For example, in one embodiment, the at least one power distribution component 358 includes a magnetic induction system that is configured to provide wireless power to one or more user input devices near the system. In one embodiment, a user input device docking region is provided, and includes a power distribution component that is configured to recharge a user input device without requiring metal-to-metal contact. In one embodiment, the at least one power distribution component 358 is configured to distribute power to one or more internal components of the system, such as one or more rechargeable power sources (e.g., rechargeable batteries) located at the system.

In certain embodiments, the at least one sensor 360 includes at least one of: optical sensors, pressure sensors, RF sensors, infrared sensors, image sensors, thermal sensors, and biometric sensors. The at least one sensor 360 may be used for a variety of functions, such as: detecting movements and/or gestures of various objects within a predetermined proximity to the system; detecting the presence and/or identity of various persons (e.g., players, casino employees, etc.), devices (e.g., user input devices), and/or systems within a predetermined proximity to the system.

The at least one data preservation component 362 is configured to detect or sense one or more events and/or conditions that, for example, may result in damage to the system and/or that may result in loss of information associated with the system. Additionally, the data preservation system 362 may be operable to initiate one or more appropriate action(s) in response to the detection of such events/conditions.

The at least one motion/gesture analysis and interpretation component 364 is configured to analyze and/or interpret information relating to detected player movements and/or gestures to determine appropriate player input information relating to the detected player movements and/or gestures. For example, in one embodiment, the at least one motion/gesture analysis and interpretation component 364 is configured to perform one or more of the following functions: analyze the detected gross motion or gestures of a player; interpret the player's motion or gestures to identify instructions or input from the player. In other embodiments, at least a portion of these additional functions may be implemented at a remote system or device.

The at least one portable power source 368 enables the system to operate in a mobile environment, such as via enabling the player to view and wager on sporting events from a hotel room mobile device. For example, in one embodiment, the system 300 includes one or more rechargeable batteries.

The at least one geolocation module 376 is configured to acquire geolocation information from one or more remote sources and use the acquired geolocation information to determine information relating to a relative and/or absolute position of the system. For example, in one implementation, the at least one geolocation module 376 is configured to receive GPS signal information for use in determining the position or location of the system. In another implementation, the at least one geolocation module 376 is configured to receive multiple wireless signals from multiple remote devices (e.g., systems, servers, wireless access points, etc.) and use the signal information to compute position/location information relating to the position or location of the system.

The at least one user identification module 377 is configured to determine the identity of any current players utilizing a player account associated with the system. For example, in one embodiment, the current players utilizing a player account associated with the system are each required to perform a login process at the system in order to access one or more features, such as to view and wager on sporting events displayed via a hotel room system. Alternatively, the system is configured to automatically determine the identity of such players based on one or more external signals, such as an RFID tag that provides a wireless signal to the system that is used to determine the identity of the player. In at least one embodiment, various security features are incorporated into the system to prevent unauthorized users from accessing confidential or sensitive information.

The at least one information filtering module 379 is configured to perform filtering (e.g., based on specified criteria) of selected information to be displayed at one or more displays 335 of the system.

In various embodiments, the system includes a plurality of communication ports configured to enable the at least one processor of the system to communicate with and to operate with external peripherals, such as: accelerometers, arcade sticks, bar code readers, bill validators, biometric input devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

In various embodiments, in addition to or alternative from the system communicating to a hotel video system data associated with the display of available sports wagering opportunities associated with displayed sporting events (such that the system enables a player to participate in the placement of wagers on available sporting event wagering opportunities in the player's hotel room), the system includes or is associated with one or more servers configured to communicate with a personal gaming device—such as a smartphone, a tablet computer, a desktop computer, or a laptop computer—to enable web-based wagering (including, but not limited to sporting event wagering) or game play using the personal gaming device. In various embodiments, the player must first access a gaming website via an Internet browser of the personal gaming device or execute an application (commonly called an "app") installed on the personal gaming device before the player can use the personal gaming device to participate in web-based wagering or game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as available sporting event wagering opportunities and corresponding award), the one or more servers send the content to the personal gaming device, and the personal gaming device displays the content.

In certain such embodiments, the one or more servers must identify the player before enabling wagering on sporting event wagering opportunities on the personal gaming device (or, in some embodiments, before enabling monetary wager-based activity or game play on the personal gaming device). In these embodiments, the player must identify herself to the one or more servers, such as by inputting the player's unique playername and password combination, providing an input to a biometric sensor (e.g., a fingerprint sensor, a retinal sensor, a voice sensor, or a facial-recognition sensor), or providing any other suitable information. In another embodiment, a sporting event wagering location, such as the hotel room, has a beacon or other proximity sensors that operate with the sporting event wagering system to detect devices and/or the identifiers of the person using the devices and utilize this information to determine the level of verification required to enable wagering on sporting event wagering opportunities. For example, if a player checked into the system as alone (e.g., the player checked into the hotel room as one guest) but the sensors detect multiple devices (e.g., phones, watches, wearables, or medical devices) that indicate that multiple people are at the sporting event wagering location, then the system prompts for an additional level of verification, such as a PIN, prior to enabling wagering on sporting event wagering opportunities. In another example, if a player checked into the system with minor guests, upon the sensors detecting that a device associated with the minor guest is at the sporting event wagering location, the system prompts for an additional level of verification, such as a PIN, prior to enabling wagering on sporting event wagering opportunities.

Once identified, the one or more servers enable the player to establish an account balance from which the player can draw credits usable to wager on available sporting event wagering opportunities. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers enable web-based wagering on sporting event wagering opportunities using a personal gaming device only if the personal gaming device satisfies one or more jurisdictional requirements. In one embodiment, the one or more servers enable web-based wagering on sporting event wagering opportunities using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based activity if the personal gaming device is located outside of the designated geographic area.

In various embodiments, the system is configured to communicate with a personal gaming device—such as a smartphone, a tablet computer, a desktop computer, or a laptop computer—to enable tethered mobile game play using the personal gaming device. Generally, in these embodiments, the system establishes communication with the personal gaming device and enables the player to place wagers on sporting event wagering opportunities remotely via the personal gaming device. In certain embodiments, the system includes or is otherwise associated with a geo-fence system that enables tethered wagering on sporting event wagering opportunities within a particular geographic area but not outside of that geographic area.

In certain embodiments, the system is configured to communicate with a social network server that hosts or partially hosts a social networking website via a data network (such as the Internet) to integrate a player's gaming experience with the player's social networking account. This enables the system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the system to receive certain information from the social network server, such as the player's likes or dislikes or the player's list of connections. In certain embodiments, the system enables the player to link the player's player account to the player's social networking account(s). This enables the system to, once it identifies the player and initiates a wagering session (such as via the player logging in to a website (or an application) on the player's personal gaming device or via the player inserting the player's player tracking card to place one or more sporting event wagers), link that gaming session to the player's social networking account(s). In other embodiments, the system enables the player to link the player's social networking account(s) to individual gaming sessions when desired by providing the required login information. For instance, in one embodiment, if a player wins a particular award for placing a sporting event wager from their hotel room, the system sends information about the award to the social network server to enable the server to create associated content and to post that content to the player's wall (or other suitable area) of the social networking website for the player's connections to see (and to entice them to play).

It should be appreciated that the terminology used herein is for the purpose of describing particular aspects only and is not intended to be limiting of the disclosure. For example, the singular forms "a", "an" and "the" are intended to include the plural forms as well, unless the context clearly indicates otherwise. In another example, the terms "including" and "comprising" and variations thereof, when used in this specification, specify the presence of stated features, steps, operations, elements, and/or components, but do not preclude the presence or addition of one or more other features, steps, operations, elements, components, and/or groups thereof. Additionally, a listing of items does not imply that any or all of the items are mutually exclusive nor does a listing of items imply that any or all of the items are collectively exhaustive of anything or in a particular order, unless expressly specified otherwise. Moreover, as used herein, the term "and/or" includes any and all combinations of one or more of the associated listed items. It should be further appreciated that headings of sections provided in this document and the title are for convenience only, and are not to be taken as limiting the disclosure in any way. Furthermore, unless expressly specified otherwise, devices that are in communication with each other need not be in continuous communication with each other and may communicate directly or indirectly through one or more intermediaries.

Various changes and modifications to the present embodiments described herein will be apparent to those skilled in the art. For example, a description of an embodiment with several components in communication with each other does not imply that all such components are required, or that each of the disclosed components must communicate with every other component. On the contrary a variety of optional components are described to illustrate the wide variety of possible embodiments of the present disclosure. As such, these changes and modifications can be made without departing from the spirit and scope of the present subject matter and without diminishing its intended technical scope. It is therefore intended that such changes and modifications be covered by the appended claims.

The invention is claimed as follows:

1. A system comprising:

a processor; and a memory device that stores a plurality of instructions that, when executed by the processor following any required authorization of a user associated with a hotel room, cause the processor to:

receive data associated with a placement, via a hotel room input device, of a sporting event wager of a first amount of funds on an outcome of a sporting event, communicate data that results in a decrease of a balance of an account based on the first amount of funds of the placed sporting event wager, wherein the account is independent of any balance of any electronic gaming machine located remote from the hotel room, and communicate data that results in a creation of a betting slip associated with the placed sporting event wager, wherein the betting slip is providable at least when the user checks out of the hotel room.

2. The system of claim 1, wherein the account comprises any of a sporting event wagering account associated with the user, and a sporting event wagering account associated with the hotel room.

3. The system of claim 2, wherein the memory device stores a plurality of further instructions that, when executed by the processor, cause the processor to create the account when the user checks into the hotel room.

4. The system of claim 1, wherein the required authorization of the user associated with the hotel room comprises a designated input made via the hotel room input device.

5. The system of claim 4, wherein the designated input comprises a personal identification number.

6. The system of claim 1, wherein the required authorization of the user associated with the hotel room comprises an age verification of the user.

7. The system of claim 1, wherein the hotel room input device comprises a mobile device paired to a component of a hotel room system.

8. The system of claim 1, wherein the memory device stores a plurality of further instructions that, when executed by the processor after a determination occurs that the placed sporting event wager comprises a winning sporting event wager, cause the processor to communicate data that results in an increase of the balance of the account based on a second amount of funds associated with the winning sporting event wager.

9. The system of claim 1, wherein the sporting event comprises any of a live sporting event, a historic sporting event and an electronic sporting event.

10. The system of claim 1, wherein the outcome of the sporting event comprises an outcome of an in-game event of the sporting event.

11. A system comprising:

a processor; and a memory device that stores a plurality of instructions that, when executed by the processor, cause the processor to:

receive data associated with a placement of a sporting event wager of a first amount of funds on an outcome of a sporting event, and communicate data that results in an increase, based on the first amount of funds of the placed sporting event wager, of a hotel room bill associated with a hotel room, wherein the hotel room bill is independent of any balance of any electronic gaming machine located remote from the hotel room, and the increase, based on the first amount of funds of the placed sporting event wager, of the hotel room bill is associated with a credit card merchant category code corresponding to lodging activity.

12. The system of claim 11, wherein the memory device stores a plurality of further instructions that, when executed by the processor after a determination occurs that the placed sporting event wager comprises a winning sporting event wager, cause the processor to communicate data that results in a decrease of the hotel room bill based on a second amount of funds associated with the winning sporting event wager.

13. A method of operating a system, the method comprising:

following any required authorization of a user associated with a hotel room:

receiving data associated with a placement, via a hotel room input device, of a sporting event wager of a first amount of funds on an outcome of a sporting event, and communicating data that results in a decrease of a balance of an account based on the first amount of funds of the placed sporting event wager, wherein the account is independent of any balance of any electronic gaming machine located remote from the hotel room, and communicating data that results in a creation of a betting slip associated with the placed sporting event wager, wherein the betting slip is providable at least when the user checks out of the hotel room.

14. The method of claim 13, wherein the account comprises any of a sporting event wagering account associated with the user, and a sporting event wagering account associated with the hotel room.

15. The method of claim 14, further comprising creating, by a processor, the account when the user checks into the hotel room.

16. The method of claim 13, wherein the required authorization of the user associated with the hotel room comprises a designated input made via the hotel room input device.

17. The method of claim 16, wherein the designated input comprises a personal identification number.

18. The method of claim 13, wherein the required authorization of the user associated with the hotel room comprises an age verification of the user.

19. The method of claim 13, further comprising, after a determination occurs that the placed sporting event wager comprises a winning sporting event wager, communicating data that results in an increase of the balance of the account based on a second amount of funds associated with the winning sporting event wager.

20. The method of claim 13, wherein the outcome of the sporting event comprises an outcome of an in-game event of the sporting event.

* * * * *